US006691371B2

(12) United States Patent
Migli

(10) Patent No.: US 6,691,371 B2
(45) Date of Patent: Feb. 17, 2004

(54) HINGE FOR FURNITURE WITH A SCREW SAFETY FASTENING SYSTEM

(75) Inventor: Carlo Migli, Lecco (IT)

(73) Assignee: Agostino Ferrari S.p.A. (IT)

( * ) Notice: Subject to any disclaimer, the term of this patent is extended or adjusted under 35 U.S.C. 154(b) by 0 days.

(21) Appl. No.: 10/291,564

(22) Filed: Nov. 12, 2002

(65) Prior Publication Data

US 2003/0106184 A1 Jun. 12, 2003

(30) Foreign Application Priority Data

Dec. 11, 2001 (IT) ..... MI20010645 U

(51) Int. Cl.[7] ..... E05D 5/00

(52) U.S. Cl. ..... 16/382; 16/387; 16/267; 16/271

(58) Field of Search ..... 16/382, 387, 237–242, 16/235, 266, 267, 245, 246, 271

(56) References Cited

U.S. PATENT DOCUMENTS 4,506,409 A * 3/1985 Lautenschlager ..... 15/238
4,642,846 A * 2/1987 Lautenschlager ..... 16/382
5,375,297 A * 12/1994 Lautenschlager et al. ..... 16/249
5,621,947 A * 4/1997 Fitz et al. ..... 16/249
5,884,364 A * 3/1999 Domenig et al. ..... 16/249
5,966,779 A * 10/1999 Salice ..... 16/382
6,167,590 B1 * 1/2001 Domenig ..... 16/382
6,203,231 B1 * 3/2001 Salice ..... 403/12
6,286,918 B1 * 9/2001 King ..... 312/326
6,460,219 B2 * 10/2002 Domenig et al. ..... 16/240

* cited by examiner

*Primary Examiner*—Chuck Y. Mah
(74) *Attorney, Agent, or Firm*—Shlesinger, Fitzsimmons & Shlesinger

(57) ABSTRACT

A hinge for furniture comprises a fastening base (11) carrying the hinge articulation (14). The fastening base has a slot (18) passed through by a screw (12) for fastening to the piece of furniture. The slot (18) is open towards the base edge through a channel (19) of a width smaller than the slot width. The fastening screw under the head is provided with a collar (21) which is housed in the slot (18) and the diameter of which is greater than the width of at least one channel portion (19). Thus passage of the screw through the channel is inhibited if the screw is not untightened a sufficient amount to bring the collar out of the slot.

5 Claims, 1 Drawing Sheet

HINGE FOR FURNITURE WITH A SCREW SAFETY FASTENING SYSTEM

BACKGROUND OF THE INVENTION

The present invention relates to a hinge for furniture provided with a screw safety fastening system. A problem known in the field of furniture hinges is to prevent untightening of the adjusting screw from causing detachment of the hinge or parts thereof (in the case of an adjustable base separated from the true hinge, for example), giving rise, as a result, to falling of the hinged door. Screw unfastening can take place both due to accidental causes and for the purpose of enabling adjustment of the door position.

In relatively complicated hinges in which a relatively great bulkiness is allowed, safety systems that are rather complicated have been proposed, which normally use several screws or sliding guides and closed slots for receiving the screws and prevent separation of the parts if the hinge does not follow a preestablished inclination movement that practically cannot be caused by accident.

In simpler hinges or hinges that must have a limited bulkiness, taking advantage of these safety systems becomes very difficult and even impossible. Hinges that cannot generally employ the above mentioned systems are for example the single-pin hinges commonly referred to as "frame" hinges. For these hinges the proposed solution involves making a slot for screw fastening, which slot is open at the rear part thereof to enable removal of the hinge from the screw by slipping off but provided with teeth or projections on the sliding plane of the hinge which interfere with the screw head if the screw has not been untightened to a sufficient degree. In such a solution however, further working of the hinge for making the teeth is required (said teeth may be obtained for example through bending from the base plane). In addition, since the teeth must project from the fastening plane, they can easily scratch the installer or the person that will utilise the piece of furniture. During the normal cleaning operations carried out at the inside of the piece of furniture these teeth may also become an easy grip for the cleaning cloths. It is a general aim of the present invention to obviate the above mentioned drawbacks by providing a hinge with a fastening system which is safe against accidental removal of the hinge by slipping off from the fastening screws, while at the same time being simple, of no additional bulkiness and of reduced cost.

SUMMARY OF THE INVENTION

In view of this aim a hinge for furniture in accordance with the present invention has been conceived which comprises a fastening base carrying the hinge articulation, the fastening base having a slot passed through by a screw for fastening to the piece of furniture, characterised in that the slot is open towards the base edge through a channel, which channel has a smaller width than the width of the slot, and the fastening screw being provided, under its head, with a collar that is housed in the slot and the diameter of which is greater than the width of at least one portion of the channel, so as to inhibit passage of the screw through the channel if the screw is not untightened a sufficient amount to bring the collar out of the slot.

BRIEF DESCRIPTION OF THE DRAWINGS

For better explaining the innovative principles of the present invention and the advantages it offers over the known art, a possible embodiment applying the above principles will be described hereinafter by way of non-limiting example, with the aid of the accompanying drawings. In the drawings.

DETAILED DESCRIPTION OF THE INVENTION

Figure 1:
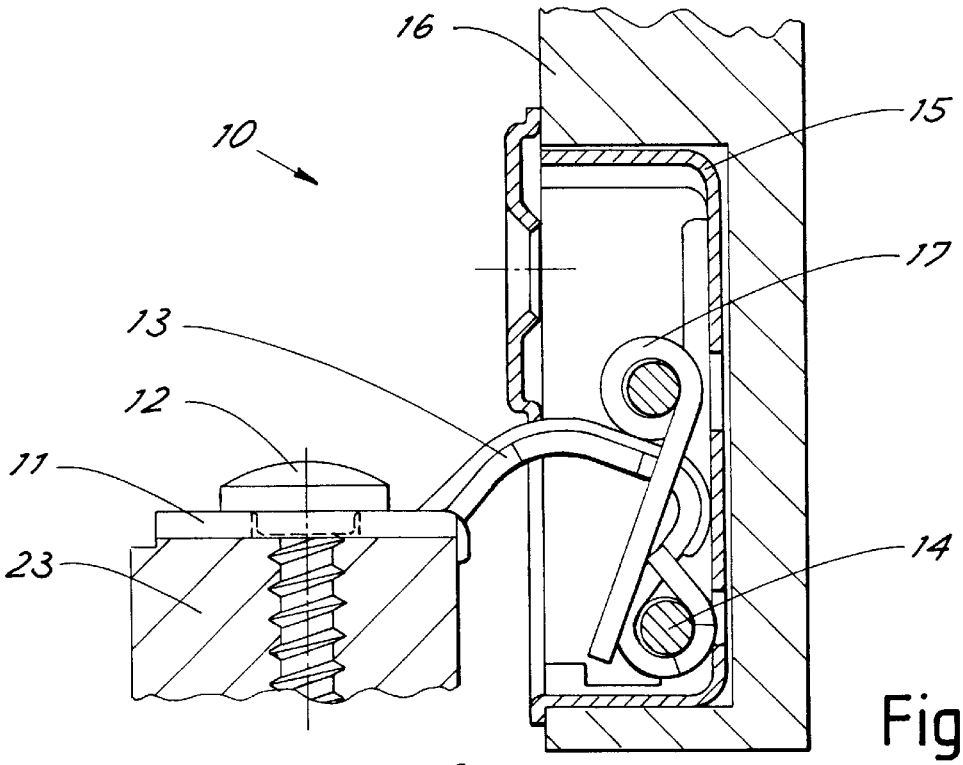
FIG. 1 is a view partly in section of a hinge of the "frame" type in accordance with the invention.
Figure 2:
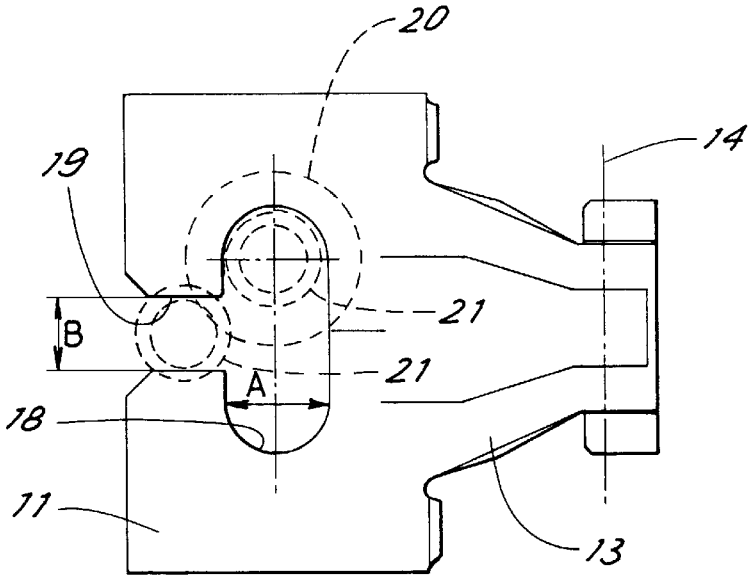
FIG. 2 is a plan view of a base portion of the hinge shown in FIG. 1.

With reference to the drawings, a hinge (generally denoted by 10) is shown in FIG. 1. The hinge comprises a base 11, fastened by a screw 12 to a shoulder 23 of a piece of furniture, and a bowl-shaped element 15 fastened to a door 16. The base has an arm 13 pivotally mounted to the bowl by means of a terminal portion thereof or pivot 14. Spring means 17 may be also present in the bowl for assisting opening and/or closing of the hinge, as known. As shown in FIG. 2, the hinge base (generally in the shape of a plate) comprises a slot 18 extending in a direction transverse to the hinge, i.e. parallel to pivot 14.

A channel 19 connects the slot 18 to the rear edge of base 11. The slot and channel advantageously form a T-shaped configuration. The width "A" of the slot is greater than the width "B" of the channel.

Figure 3:
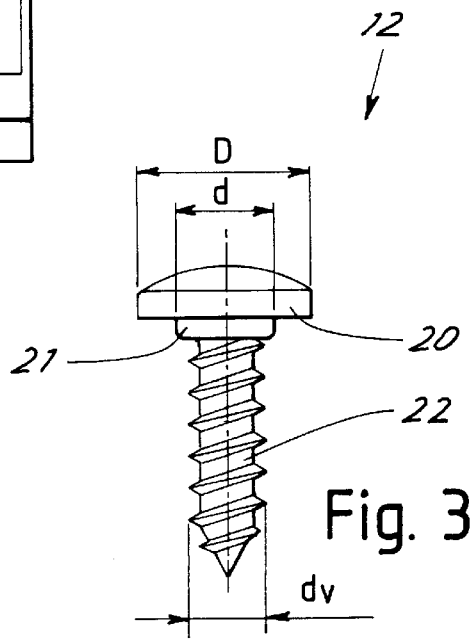
FIG. 3 is a side view of a fastening screw being part of the hinge shown in FIG. 1.

A special screw 12 shown in more detail in FIG. 3 is received in the slot. As viewed from said figure, screw 12 is provided with a collar 21 under its head 20, the diameter "d" of which is intermediate between the diameter "D" of the head 20 itself and the diameter "$d_v$" of the threaded shank 22.

In particular, head 20 is of a greater diameter than the width "A" of the slot so that the screw cannot slip off through the slot, whereas collar 21 is of a diameter "d" not exceeding the width "A" of the slot, so that it can be housed in the slot itself (as shown in FIGS. 1 and 2), but greater than the width "B" of channel 19. Collar 21 is of a height approximately corresponding to (advantageously slightly smaller than or at least equal to) the thickness of base 11. On the contrary, the diameter $d_v$ of the screw shank is smaller than the width "B" of channel 19.

In this way, the screw will not be able to leave the slot until the screw itself has been unscrewed a sufficient amount to bring the whole collar 21 above the slot edge, i.e. out of the upper surface of the base plate 11. By untightening the screw to a smaller extent the transverse position of the hinge can be safely adjusted by making the slot 18 slide on the screw. Even an accidental unscrewing of the screw causes the fastening to be loose (so that one is warned about untightening) without on the other hand causing sudden detachment of the door.

By unfastening the screw at least by an amount corresponding to the collar height, the screw shank 22 can pass through channel 19 and the hinge can be easily separated from the piece of furniture.

At this point it is apparent that the intended purposes have been achieved, by supplying a hinge with a cheap and sure safety fastening system inhibiting an accidental detachment of the hinge due to untightening of the fastening screw.

It should be noted that with the described system, no further forming operation is required on the hinge, but only cutting out of the slot in a particular shape, which cutting-out although of different shape is an already foreseen operation. In addition, it should be pointed out that no projection must be provided with respect to the plane of the base 11 and this avoids any risk of a cloth or the like getting caught.

The collar suitably sized also constitutes an improved guide for sliding of the screw along the slot during the adjusting operations.

Obviously, the above description of an embodiment applying the innovative principles of the present invention is given by way of example only and therefore must not be considered as a limitation of the scope of the patent rights herein claimed. For example, the hinge shape can be different from that herein shown by way of example. The channel for passage of the screw may have a smaller width than the collar diameter only at one portion thereof. In addition, the base may be provided with drawn portions or grooves surrounding the slot and/or the channel to increase the real height of the base.

What is claimed is:

1. A hinge for furniture comprising a fastening base carrying the hinge articulation, the fastening base having a slot passed through by a screw for fastening to the piece of furniture, characterised in that the slot is open towards the base edge through a channel, the channel having a width smaller than the slot width, and the fastening screw being provided, under the head, with a collar that is housed in the slot and is of a greater diameter than the width of at least one portion of the channel so as to inhibit passage of the screw through the channel if the screw is not untightened a sufficient amount to bring the collar out of the slot.

2. A hinge as claimed in claim 1, characterised in that the collar is approximately of the same height as the slot thickness.

3. A hinge as claimed in claim 1, characterised in that the slot and channel generally form a T-shaped configuration.

4. A hinge as claimed in claim 1, characterised in that the slot is parallel to the articulation.

5. A hinge as claimed in claim 1, characterised in that it is a single-pin hinge of the type called "frame" and the base is a plate into which the slot and channel are cut out.

* * * * *